US010533332B2

(12) United States Patent
Johnson

(10) Patent No.: US 10,533,332 B2
(45) Date of Patent: Jan. 14, 2020

(54) FORM BRACE AND METHOD OF FORMING A CONCRETE SLAB

(71) Applicant: Edward Johnson, Lincolnville, SC (US)

(72) Inventor: Edward Johnson, Lincolnville, SC (US)

( * ) Notice: Subject to any disclaimer, the term of this patent is extended or adjusted under 35 U.S.C. 154(b) by 74 days.

(21) Appl. No.: 15/703,921

(22) Filed: Sep. 13, 2017

(65) Prior Publication Data

US 2018/0073259 A1 Mar. 15, 2018

Related U.S. Application Data

(63) Continuation of application No. 62/394,082, filed on Sep. 13, 2016.

(51) Int. Cl.
*E04G 17/14* (2006.01)

(52) U.S. Cl.
CPC ..... *E04G 17/14* (2013.01)

(58) Field of Classification Search
CPC ..... E04G 17/14
USPC ..... 249/2, 3, 4, 5, 6, 7, 8, 208, 34, 210
See application file for complete search history.

(56) References Cited

U.S. PATENT DOCUMENTS 1,542,886 A * 6/1925 Hotchkiss ..... E01C 19/502 249/7
1,576,846 A * 3/1926 Pomfret ..... E04G 11/46 248/357
1,763,483 A * 6/1930 Seward ..... E04G 17/18 249/210
2,714,755 A * 8/1955 Wright ..... E04G 25/04 24/268
4,101,111 A * 7/1978 Bishop ..... B28B 7/0017 248/351
4,393,568 A * 7/1983 Navarro ..... E04F 13/00 227/119
5,096,155 A * 3/1992 Fitzgerald ..... E01C 19/502 249/219.1
5,788,875 A * 8/1998 Walser ..... E04G 5/04 249/207
5,817,247 A * 10/1998 Colatruglio ..... E01C 19/502 249/4
5,843,327 A * 12/1998 Lindgren ..... E04G 11/087 249/210
7,051,988 B2 * 5/2006 Shaw ..... E04G 13/00 248/309.1
7,097,147 B2 * 8/2006 Shaw ..... E04G 13/00 248/201

(Continued)

FOREIGN PATENT DOCUMENTS

CH 113685 A * 2/1926 ..... E04G 17/14
DE 202012008220 U1 * 3/2013 ..... E04G 17/14
WO WO-2013016760 A1 * 2/2013 ..... E04G 17/14

*Primary Examiner* — Michael Safavi
(74) *Attorney, Agent, or Firm* — Dale Jensen, PLC; Dale Jensen

(57) ABSTRACT

Certain exemplary embodiments can provide a system comprising a brace. The brace can comprise a base. The brace can further comprise a forming board coupling flange. The base is substantially perpendicular to the forming board coupling flange. The forming board coupling flange defines a plurality of form apertures. The brace constructed to receive a forming board and be coupled to the forming board via a plurality of fasteners extending through the plurality of form apertures.

10 Claims, 6 Drawing Sheets

(56) References Cited

U.S. PATENT DOCUMENTS

| | | | | |
|---|---|---|---|---|
| 7,828,263 | B2 * | 11/2010 | Bennett | E04G 17/14 249/2 |
| 2006/0201743 | A1 * | 9/2006 | Dell'Erba | E04G 13/00 182/82 |
| 2007/0215786 | A1 * | 9/2007 | Nadler | E04G 17/14 249/163 |
| 2017/0320235 | A1 * | 11/2017 | Douglas | B28B 23/005 |

* cited by examiner

1000

1000

1000

FORM BRACE AND METHOD OF FORMING A CONCRETE SLAB

CROSS-REFERENCES TO RELATED APPLICATIONS

This application claims priority to, and incorporates by reference herein in its entirety, U.S. Provisional Patent Application Ser. No. 62/394,082, filed Sep. 13, 2016.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
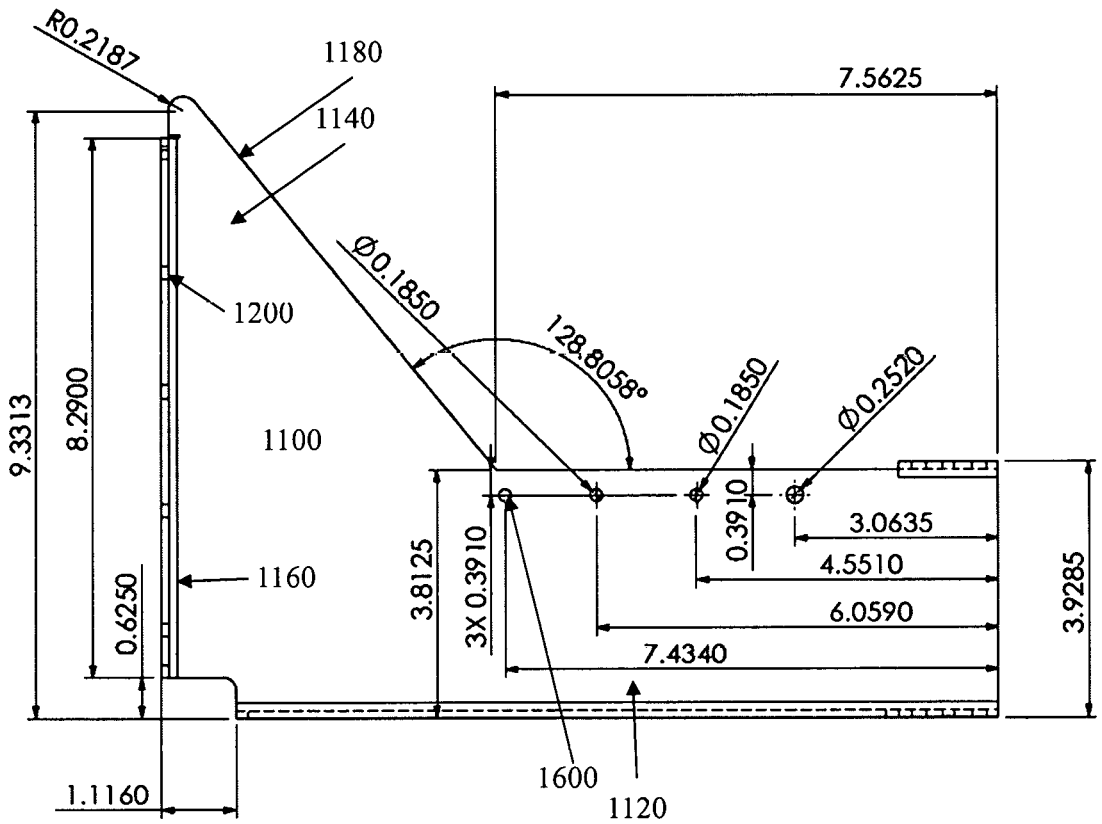
FIG. 1 is a plan view of an exemplary embodiment of a brace 1000.

Certain exemplary embodiments can provide a system comprising a brace. The brace can comprise a base. The brace can further comprise a forming board coupling flange. The base is substantially perpendicular to the forming board coupling flange. The forming board coupling flange defines a plurality of form apertures. The brace constructed to receive a forming board and be coupled to the forming board via a plurality of fasteners extending through the plurality of form apertures.

Certain exemplary embodiments provide a device which can be called a "Monolithic Slab Easy-Forming SmartBrace". Certain exemplary embodiments are designed to reduce an amount of labor that it takes to form and remove the materials after forming and pouring a monolithic slab.

Certain exemplary embodiments comprise an angle that is a substantially flat bar, which is constructed to be attached to a round metal peg (e.g., a round metal peg having a diameter of approximately 0.75 inches) or a stake (e.g., a substantially rectangular wood stake that has a cross section of approximately 2 inches by approximately 4 inches) using a screw, nail, and/or pin (e.g., a fastener having a length of approximately 1.25 inches). Certain exemplary embodiments can be pinned as close to the ground as possible for maximum efficiency. Once the SmartBrace is stabilized in a firm ground surface, a forming board is attached with fasteners (e.g., screws or nails having a length of approximately 1.25 inches). The form board can be uniquely suspended without any support from the bottom such as a wooden stake or rod. The pad for the slab should be as level as possible on its corners. This helps to avoid sloping from one end to the opposing end. There should be some clearance (e.g., 24 inches or more) from the form on the outside in order to run the SmartBrace in a straight line and on level ground. SmartBrace is capable of supporting and extension up to a predetermined height (e.g., approximately four feet).

Certain exemplary embodiments can be made in various sizes (e.g., approximately 10 inches and approximately 20 inches).

FIG. 1 is a plan view of an exemplary embodiment of a brace 1000, which comprises base 1100, a forming board coupling flange 1200, and at least one supplemental aperture 1600. The distance dimensions of the illustrated embodiment in FIG. 1, including aperture dimensions, are in inches. The angular dimensions of the illustrated embodiment in FIG. 1 are in degrees. Base 1100 has a general appearance of a rectangle (see rectangle 1120 of base 1100 illustrated in FIG. 1) with a shape resembling a right triangle (see triangle 1140 of base 1100 illustrated in FIG. 1) defined by an extended edge 1160 of the rectangle 1120 and a hypotenuse 1180 of triangle 1140 intersecting with an edge of rectangle 1120.

Figure 2:
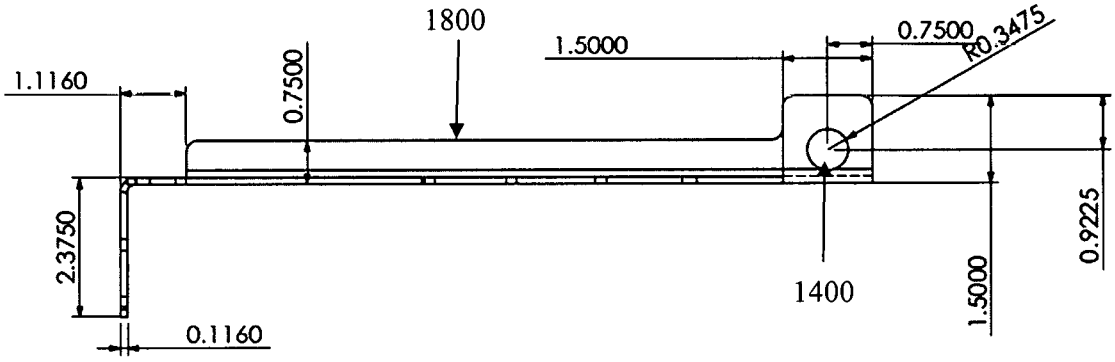
FIG. 2 is a side view of an exemplary embodiment of brace 1000.

FIG. 2 is a side view of an exemplary embodiment of brace 1000. The distance dimensions of the illustrated embodiment in FIG. 2, including aperture dimensions, are in inches.

Figure 3:
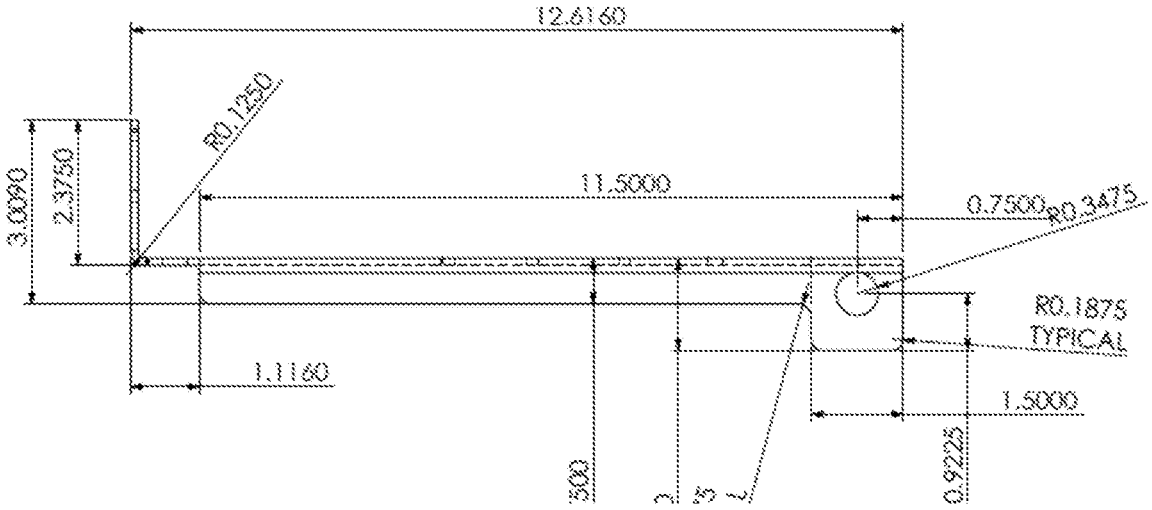
FIG. 3 is a plan view of an exemplary embodiment of brace 1000.

FIG. 3 is a side view of an exemplary embodiment of brace 1000. The distance dimensions of the illustrated embodiment in FIG. 3, including aperture dimensions, are in inches.

Figure 4:
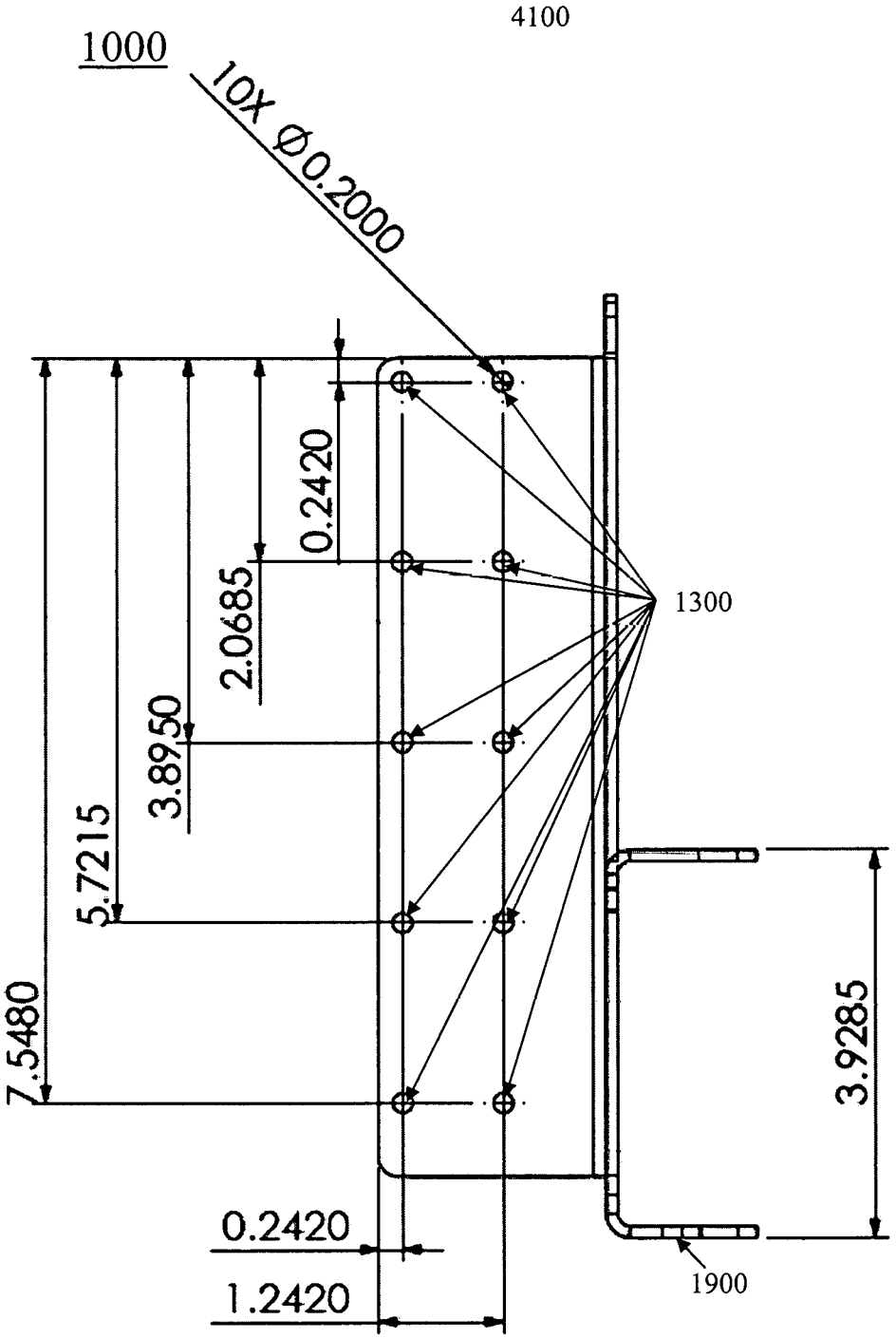
FIG. 4 is a end view of an exemplary embodiment of brace 1000.

FIG. 4 is a end view of an exemplary embodiment of brace 2000. The distance dimensions of the illustrated embodiment in FIG. 4, including aperture dimensions, are in inches.

The dimensions of the illustrated embodiment shown in FIGS. 1-4 are illustrative and not limiting. Dimensions and/or angles that are illustrated can be varied as desired by one skilled in the art in order to achieve form structure and stability as desired.

Figure 5:
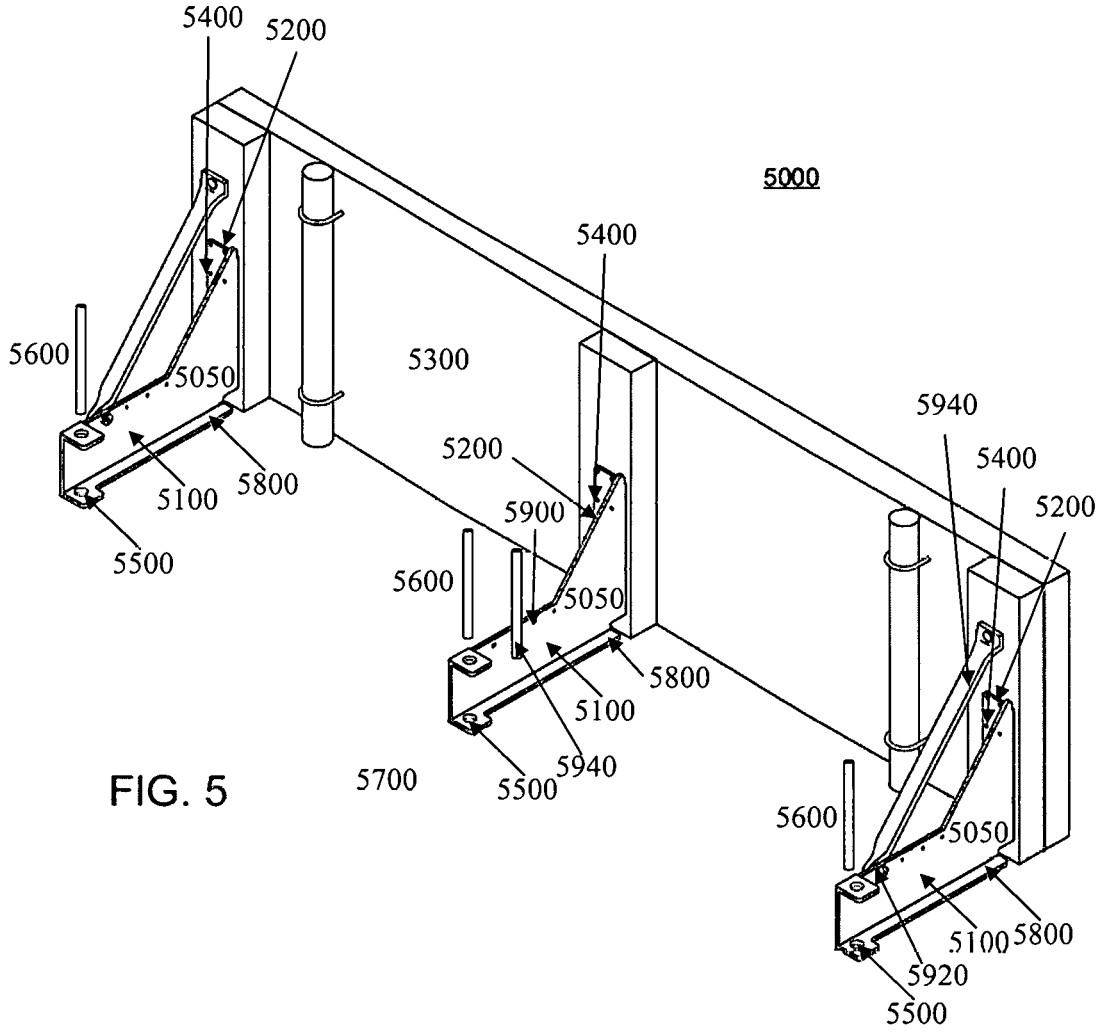
FIG. 5 is a perspective view of an exemplary embodiment of system 5000.

FIG. 5 is a perspective view of an exemplary embodiment of system 5000, which comprises braces 5050. Braces 5050 each comprise:

a base 5100; and a forming board coupling flange 5200, wherein base 5100 is substantially perpendicular to a forming board coupling flange 5200; forming board coupling flange 5200 defining a plurality of form apertures (see form apertures 1300 of FIG. 4), base 5100 is constructed to receive a forming board 5300 and be coupled to forming board 5300 via a plurality of fasteners 5400 engaged via plurality of form apertures (see form apertures 1300 of FIG. 4), base 5100 defining a stake aperture 5500, stake aperture 5500 constructed to receive a first stake 5600 (illustrated above stake aperture 5500 prior to being placed therethrough), first stake 5600 restraining braces 5050 from motion relative to a location where first stake 5600 constructed to be driven into a penetrable surface 5700, when first stake 5600 is driven into penetrable surface 5700 and coupled to braces 5050, first stake 5600 restraining motion of braces 5050 relative to penetrable surface 5700, wherein braces 5050, when coupled to forming board 5300, supports forming board 5300 with substantially no additional support under forming board 5300.

Stake aperture 5500 is defined in a portion of braces 5050 having a channel shaped cross section (see channel shaped cross section 1900 as illustrated of FIG. 4). Stake aperture 5500 is defined in a portion of the braces 5050 that comprises a gusset 5800 coupled to base 5100 (see also gusset 1800 as illustrated of 2).

Braces 5050 can be substantially unitary and lack weldments. Braces 5050 defines an extension aperture 5920 that is constructed to couple braces 5050 to a brace extension 5940. Braces 5050 defines at least one supplemental aperture 5900 that is constructed to couple braces 5050 to a second stake 5980.

Brace 1000 can be anchored to the earth. The penetrable surface can be the earth.

Figure 6:
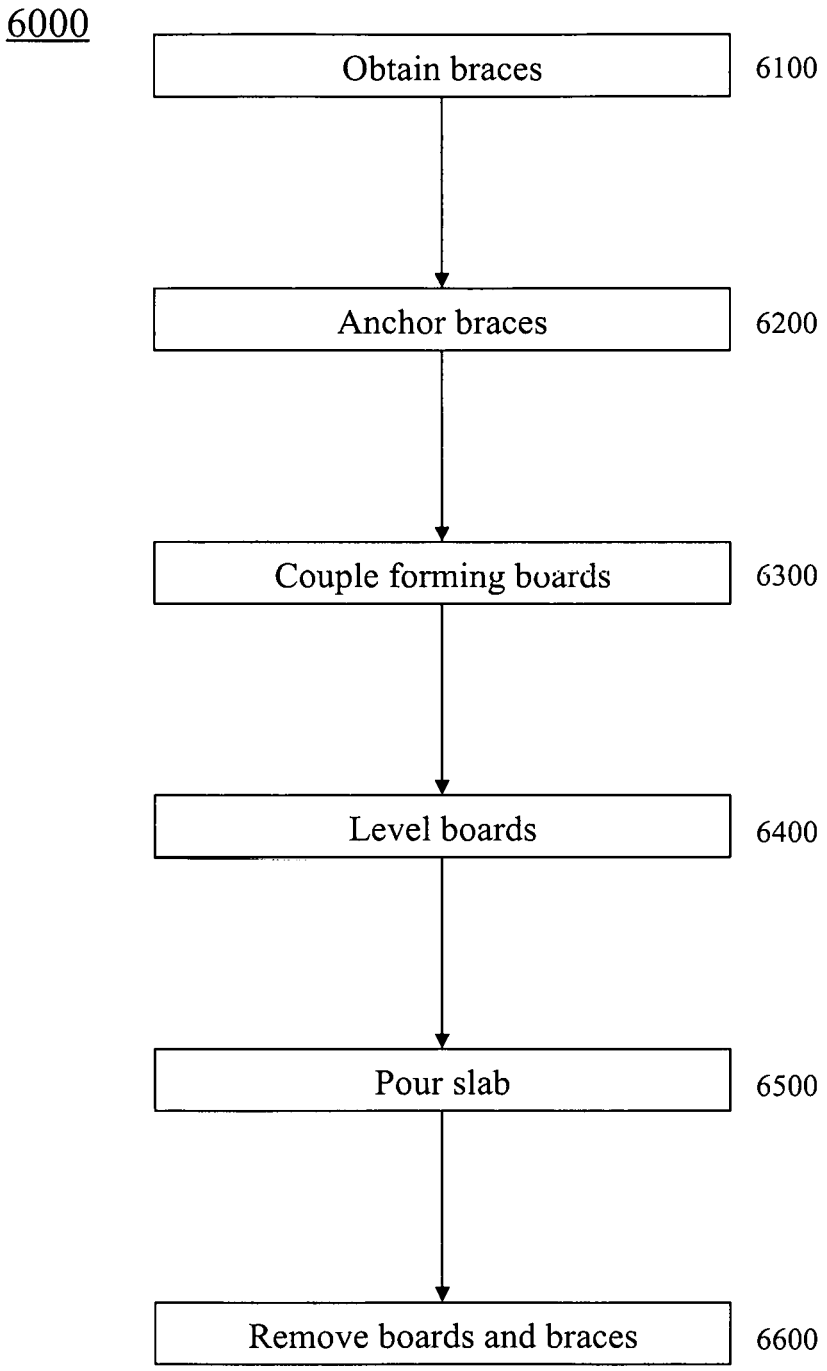
FIG. 6 is a flowchart of an exemplary embodiment of a method 6000.

FIG. 6 is a flowchart of an exemplary embodiment of a method 6000. At activity 6100, braces can be obtained. At activity 6200, the braces can be anchored to the ground. At activity 6300, forming boards can be coupled to the braces. At activity 6400, the forming boards can be leveled. At activity 6500, a slab can be poured inside of the forming boards. Certain exemplary embodiments can cause a concrete slab to be poured in a form that comprises a forming board. The forming board can be coupled to a brace. The brace comprises a base and a forming board coupling flange. The base is substantially perpendicular to the forming board coupling flange. The forming board coupling flange defines a plurality of form apertures. The brace is constructed to receive the forming board and be coupled to the forming board via a plurality of fasteners extending through the plurality of form apertures. The brace defines a stake aperture. The stake aperture is constructed to receive a first stake. The first stake restrains the brace from motion relative to a location where the first stake constructed to be driven into a support base. When the first stake is driven into the support base and coupled to the brace, the first stake restrains motion of the brace relative to the support base. The brace, when coupled to the forming board, supports the forming board with substantially no additional support under the forming board.

At activity 6600, the boards and braces can be removed once the slab has cured and hardened.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof
adapter—a device used to effect operative compatibility between different parts of one or more pieces of an apparatus or system.
additional—supplemental to a basic level.
anchor—to connect an object to something substantial that can substantially prevent the object from moving.
and/or—either in conjunction with or in alternative to.
aperture—an opening in something.
apparatus—an appliance or device for a particular purpose
associate—to join, connect together, and/or relate.
base—a supporting portion of something.
brace—a device that holds or fastens two or more parts together or in place.
can—is capable of, in at least some embodiments.
channel shaped—having a cross section with a base and two upturned sides, wherein each of the two upturned sides join the base at substantially right angles.
comprising—including but not limited to.
connect—to join or fasten together.
constructed to—made to and/or designed to.
coupleable—capable of being joined, connected, and/or linked together.
coupling—linking in some fashion.
define—to establish the outline, form, or structure of
determine—to obtain, calculate, decide, deduce, and/or ascertain.
device—a machine, manufacture, and/or collection thereof.
engage—to be in contact and interact with.
extension—something added to lengthen an object.
fastener—one (or more) restraints that attach to, extend through, penetrate, and/or hold something. For example, a fastener can be one (or more) bolt and nut assembly, rivet, weldment, nail, screw, peg, staple, clip, buckle, clasp, clamp, hook and loop assembly, adhesive, and/or plastic push rivet, etc.
form—a mold into which concrete is poured, which mold is shaped such that the concrete sets in a predetermined desired shape and size.
forming board—a piece of wood or the equivalent that is coupleable to be a part of a form.
forming board coupling flange—a portion of a brace that is directly coupleable to a forming board via fasteners.
gusset—a piece of material coupleable to a brace that strengthens the brace and resists deformation of the brace.
hypotenuse—a longest side of a right triangle.
install—to connect or set in position and prepare for use.
lack—to be substantially devoid of
may—is allowed and/or permitted to, in at least some embodiments.
method—a process, procedure, and/or collection of related activities for accomplishing something.
motion—a process via which something changes position from one location to another.
penetrable surface—an exterior boundary of something that is pierceable with a stake, for example, in many locations the earth comprises a penetrable surface.
plurality—the state of being plural and/or more than one.
predetermined—established in advance.
provide—to furnish, supply, give, and/or make available.
rectangle—a four sided polygon defined by four right angles where the sides intersect.
relative to—in relation to a definable object
restrain—to limit motion of something.
set—a related plurality.
stake—a stick or post pointed at one end for driving into a surface, such as the earth's surface, as a support for a form.
substantially—to a great extent or degree.
supplemental—added to supply something that would otherwise not be present.
support—to bear the weight of, especially from below.
system—a collection of mechanisms, devices, machines, articles of manufacture, processes, data, and/or instructions, the collection designed to perform one or more specific functions.
triangle—a three sided polygon.
unitary—substantially comprising only a single piece.
via—by way of and/or utilizing.

weldment—a junction between two parts of an object that is fused after having been softened by heat.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A method comprising:

causing a concrete slab to be poured in a form that comprises a forming board, the forming board coupled to a brace, the brace comprising:

a base; and a forming board coupling flange, the base substantially perpendicular to the forming board coupling flange, the base having an irregular pentagonal cross-section, wherein a fourth side of the irregular pentagon forms a right angle with a fifth side of the irregular pentagon and the fifth side of the irregular pentagon forms a right angle with a second side of the irregular pentagon, wherein the forming board coupling flange is coupled to the base along an first side of the base that forms a right angle with a second side of the irregular pentagonal cross-section, the first side of the base forming an acute angle with a third side of the irregular pentagonal cross-section;

the forming board coupling flange defining a plurality of form apertures, the brace constructed to receive the forming board and be coupled to the forming board via a plurality of fasteners extending through the plurality of form apertures, the brace defining a stake aperture, the stake aperture constructed to receive a first stake, the first stake restraining the brace from motion relative to a location where the first stake constructed to be driven into a penetrable surface, when the first stake is driven into the penetrable surface and coupled to the brace, the first stake restraining motion of the brace relative to the penetrable surface, wherein the brace, when coupled to the forming board, supports the forming board with substantially no additional support under the forming board.

2. A system comprising:

a brace, the brace comprising:

a base; and a forming board coupling flange, the base substantially perpendicular to the forming board coupling flange, the base having an irregular pentagonal cross-section, wherein a fourth side of the irregular pentagon forms a right angle with a fifth side of the irregular pentagon and the fifth side of the irregular pentagon forms a right angle with a second side of the irregular pentagon, wherein the forming board coupling flange is coupled to the base along an first side of the base that forms a right angle with a second side of the irregular pentagonal cross-section, the first side of the base forming an acute angle with a third side of the irregular pentagonal cross-section;

the forming board coupling flange defining a plurality of form apertures, the brace constructed to receive a forming board and be coupled to the forming board via a plurality of fasteners engaged via the plurality of form apertures, the brace defining a stake aperture, the stake aperture constructed to receive a first stake, the first stake restraining the brace from motion relative to a location where the first stake constructed to be driven into a penetrable surface, when the first stake is driven into the penetrable surface and coupled to the brace, the first stake restraining motion of the brace relative to the penetrable surface, wherein the brace, when coupled to the forming board, supports the forming board with substantially no additional support under the forming board.

3. The system of claim 2, wherein:
the stake aperture is defined in a portion of the brace having a channel shaped cross section.

4. The system of claim 2, wherein:
the stake aperture is defined in a portion of the brace that comprises a gusset coupled to the base.

5. The system of claim 2, wherein:
the base has a general appearance of a rectangle with a shape resembling a right triangle defined by an extended edge of the rectangle and a hypotenuse of the triangle intersecting with an edge of the rectangle.

6. The system of claim 2, wherein:
the brace substantially unitary and lacks weldments.

7. The system of claim 2, wherein:
the brace defines an extension aperture that is constructed to couple the brace to a brace extension.

8. The system of claim 2, wherein:
the brace defines at least one supplemental aperture that is constructed to couple the brace to a second stake.

9. The system of claim 2, wherein:
the brace is anchored to the earth.

10. The system of claim 2, further comprising:
the penetrable surface is the earth.

* * * * *